US006000564A

United States Patent [19]

Grau et al.

[11] Patent Number: 6,000,564

[45] Date of Patent: Dec. 14, 1999

[54] ROLLER EQUIPPED UNCOUPLING CAM

[75] Inventors: Curtiss A. Grau, Duncan; Steven C. Rumsey, Greer, both of S.C.

[73] Assignee: Westinghouse Air Brake Company, Wilmerding, Pa.

[21] Appl. No.: 09/183,769

[22] Filed: Oct. 30, 1998

Related U.S. Application Data

[62] Division of application No. 08/926,635, Sep. 10, 1997.

[51] Int. Cl.[6] ..... B61G 3/00

[52] U.S. Cl. ..... 213/100 R; 213/101; 213/104; 213/211

[58] Field of Search ..... 213/101, 102, 213/103, 104, 105, 115, 123, 124, 128, 130, 138, 150, 159, 163, 196, 211, 214, 216, 219, 116, 100 R

[56] References Cited

U.S. PATENT DOCUMENTS

| | | | |
|---|---|---|---|
| 3,856,154 | 12/1974 | Depenti | 213/116 |
| 4,080,857 | 3/1978 | Roth | 83/241 |
| 4,336,703 | 6/1982 | Thomas | 72/104 |
| 4,366,911 | 1/1983 | Gunther et al. | 213/100 R |
| 4,607,745 | 8/1986 | Wiese | 198/706 |
| 5,499,728 | 3/1996 | Rumsey | 213/211 |

*Primary Examiner*—Mark T. Le
*Attorney, Agent, or Firm*—James Ray & Associates

[57] ABSTRACT

An uncoupling cam is incorporated into a hook-type coupler. Couplers of this variety are typically found on railway transit vehicles, one hook-type coupler being fixed to each end of each transit vehicle. Moving two transit vehicles toward each other so that their ends come together will eventually cause their respective hook-type couplers to couple together automatically. It is in this manner that a passenger transit train is formed with each of its vehicles being mechanically linked to an adjacent vehicle. Each hook-type coupler has a pivotally mounted hook member that can be pivoted between a latch position and an unlatch position. A biasing means inside the hook-type coupler is used to keep the hook member normally biased to the latch position. The uncoupling cam features a solid body and a roller. The body of the cam has a uniform polygonal cross-section to an edge of which the roller is rotatably secured. The roller is adapted to rollably engage a surface of the hook member. Consequently, when the uncoupling cam is activated through a partial rotation, the hook member is forcibly pivoted to the unlatch position without significant sliding frictional engagement between the uncoupling cam and the hook member.

10 Claims, 2 Drawing Sheets

ROLLER EQUIPPED UNCOUPLING CAM

This application is a divisional application of U.S. application Ser. No. 08/926,635, filed Sep. 10, 1997.

FIELD OF THE INVENTION

This invention relates, generally, to what is known in the art as hook-type couplers, as used to mechanically join adjacent disposed ends of a pair of railway passenger transit vehicles, such as, electric trolleys and subway cars. More particularly, this invention relates to a unique and improved uncoupling cam as incorporated within a pneumatically, electrically or hydraulically operated hook-type coupler whereby the uncoupling cam includes a roller at its biasing edge to significantly reduce friction at the interface of the uncoupling cam and hook member, which not only results in a smoother, non-binding camming action to significantly reduce wear of the interacting surfaces of the cam and hook member to prolong their life, but further renders a "grease-less" characteristic to the coupler to thereby eliminate problems resulting from the presence of grease and periodic maintenance.

BACKGROUND OF THE INVENTION

It is, generally, well known that most light rail passenger transit vehicles, such as trolleys, subway cars and the like, are capable of being independently operated as a single passenger transit vehicle and are often operated as a single vehicle, particularly, during times when passenger travel is at a low volume. It is also, generally, well known that there are times when such transit vehicles are operated as a unit of two, three, or even more such transit vehicles joined together, particularly, during times of high volume passenger travel, such as the morning and evening "rush hours". Accordingly, in order to permit the operation of such multiple car units, such transit vehicles must be provided with a coupling means at their forward and rearward ends for selectively joining and un-joining the transit vehicles together as the needs change.

Most railway passenger transit vehicles of the prior art have utilized simple "hook-type" couplers for joining the adjacent ends of one such vehicle to another, which are pneumatically, electrically or hydraulically operated to uncouple the coupler incident to the disjoining of such joined adjacent ends of railway transit vehicles. That is to say, the coupler hooks are normally spring biased to a coupling position so that when the coupler on one transit vehicle is brought into contact with another, the coupler hooks will automatically engage each other to effect a coupling. The pneumatic, electric or hydraulic control incorporates responsive hardware that merely re-positions the engaged hooks so that the two transit vehicles are not coupled together thereby permitting either one of the transit vehicles to be driven away from the other.

Hook type transit couplers utilize a pivotal hook disposed within a gathering core recessed within a coupler head and includes a biasing spring to bias the pivotal hook to closed or latch position. Therefore, when a pair of such coupler heads, one each attached to an end of a transit vehicle, are brought into contact, the gathering cores are aligned so that the hook in each gathering core will engage the hook in the other gathering core to physically lock the two coupler heads together. Each gathering core includes an externally operated, rotatable unlatching cam adapted to pivot each hook away from the other hook to an unlatch position for purposes of uncoupling a pair of joined transit vehicles.

Because the rotatable uncoupling cam is triangular in form, a considerable degree of friction results between the working edge of the rotatable uncoupling cam and the hook member side surface against which the cam is acting. Because the action is entirely a sliding action, a considerable degree of wear results not only to the active camming surface of the uncoupling cam but also to the side surface of the hook member. To minimize such wear and to assure that the cam is freely rotatable, it is common practice to pack sufficient lubricant; i.e., grease, into the gathering core and particularly around the uncoupling cam to lubricate the frictional contacting interface surfaces.

Since the outward end of any uncoupled transit vehicle will naturally have an unused coupler, the gathering core in such an unused coupler will be exposed to the elements including dust, dirt and debris which will be attracted to and contained within the grease packing within the gathering core. Such contaminated grease will, of course, adversely affect the operation of the coupler and particularly the rotatable cam, often contributing to wear which the grease is intended to minimize, and even preventing proper operation of the uncoupling cam. Therefore, proper preventative maintenance requires that the gathering cores be periodically wiped and cleaned of old contaminated grease and replaced with fresh clean grease.

SUMMARY OF THE INVENTION

This invention is predicated upon our conception and development of a new and improved pneumatically, electrically or hydraulically operated hook-type coupler and, particularly, a new and improved uncoupling cam therein which includes a rotatable roller mounted thereto which is disposed at a location to be biased and rotated against the adjacent coupler hook member thereby greatly reducing, if not completely eliminating, the sliding frictional forces between the uncoupling cam and coupler hook member. The reduced frictional forces will not only provide a smoother operation to the camming action and prolong the life of the two main wear components (the cam and hook member) and better assure their continued proper operation but will further eliminate the need for any lubricant, such as grease, to render a "grease-less" characteristic to the coupler.

In essence, the subject invention is directed to a hook-type coupler for attachment to an end of a railway transit vehicle for joining adjacent ends of a pair of such railway transit vehicles which like prior art hook-type couplers includes a coupler head having a gathering core with a hook member pivotally mounted within the gathering core and being pivotal between a latch position and an unlatch position and, of course, is adapted to engage a second pivotally mounted hook member in a second hook-type coupler of compatible design when the gathering cores are brought into contact. The physical structures of each coupler must be compatible to the extent that a protruding end of each pivotal hook member will pass into the gathering core of the other coupler while such hooks members are pivoted to such latch position and the two hook members spring biased so that they will close on and engage each other to lock the two respective transit vehicles together. To that end, the coupler of this invention, like those of the prior art, must include a biasing means within the gathering core for pivotally biasing the pivotally mounted hook member to the latch position. Like prior art couplers, the coupler of this invention further includes an uncoupling cam within the gathering core for overcoming the biasing means to selectively pivot the hook member to the unlatch position and an externally operated actuator to selectively rotate the uncoupling cam through an angle sufficient to pivot the hook member to the unlatch position to thereby uncouple the two hook members and, accordingly, permit uncoupling of the joined transit vehicles. Unlike the prior art, however, the uncoupling cam of this invention is provided with a roller at the edge thereof contacting the hook member to eliminate, or at least greatly minimize, sliding friction at the interfaces between the uncoupling cam and the hook member which not only provides a smoother operating cam and significantly reduced wear on the uncoupling cam and hook member to greatly increase their life but also eliminates, or at least greatly reduces, the need for a lubricant to render a "grease-less" characteristic to the coupler.

OBJECTS OF THE INVENTION

Accordingly, it is a primary object of this invention to provide a new and improved uncoupling cam for use in all hook-type couplers for use on railway passenger transit vehicles whereby the uncoupling cam is provided with a roller for contacting and pivoting the coupler hook member to an unlatch position.

Another primary object of this invention is to provide a new and improved pneumatically, electrically or hydraulically operated hook-type coupler having a new and improved uncoupling cam therein which eliminates or substantially reduces sliding frictional forces between the cam and coupler hook member.

A further object of this invention is to provide a pneumatically, electrically or hydraulically operated hook-type coupler for use on railway passenger transit vehicles which includes an uncoupling cam provided with a roller for rollably contacting and pivoting the coupler hook member to an unlatch position thereby eliminating or reducing sliding frictional forces between the cam and coupler hook member.

Still another object of this invention is to provide a pneumatically, electrically or hydraulically operated hook-type coupler for use on railway passenger transit vehicles which includes an uncoupling cam provided with a roller for rollably contacting and pivoting the coupler hook member to an unlatch position thereby significantly reducing wear on the contacting surfaces of the uncoupling cam and coupler hook member.

An even further object of this invention is to provide a pneumatically, electrically or hydraulically operated hook-type coupler for use on railway passenger transit vehicles which includes an uncoupling cam provided with a roller for rollably contacting and pivoting the coupler hook member to an unlatch position to thereby render a "grease-less" characteristic to the hook-type coupler.

These and other objects and advantages of this invention will become apparent after a full reading of the following detailed description, particularly, when read in conjunction with the attached drawings as described below.

DESCRIPTION OF THE PREFERRED EMBODIMENT OF THE INVENTION

Figure 1:
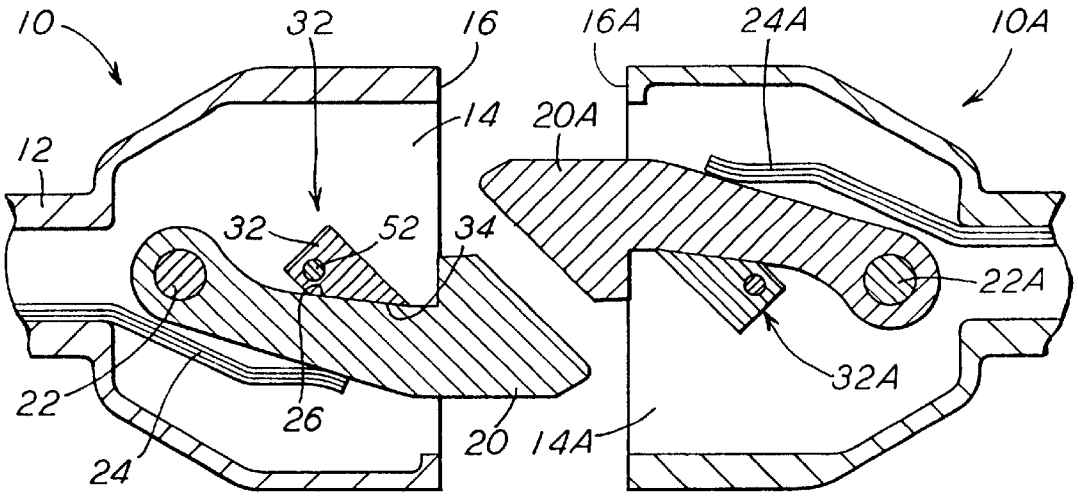
FIG. 1 PRIOR ART
FIG. 1 is a schematic cross-sectional plan view of a pair of spaced prior art coupler heads with both hook members in the latch position as necessary to be coupled together.

Prior to proceeding with a detailed description of the subject invention, it is noted that for the sake of clarity, identical components which have identical functions have been identified with identical reference numerals throughout the several views of the attached drawings.

Figure 2:
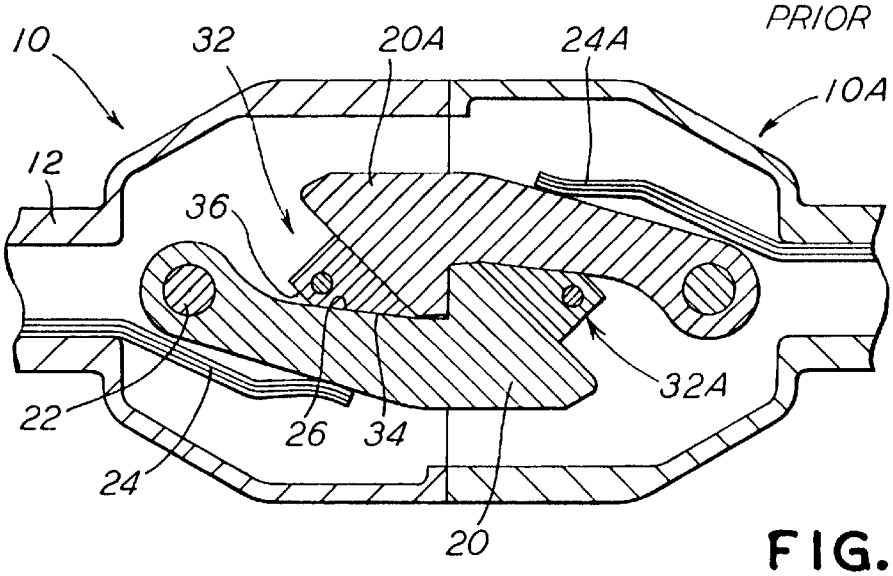
FIG. 2 PRIOR ART
FIG. 2 is another schematic cross-sectional plan view of a pair of prior art coupler heads identical to FIG. 1, but instead showing the couplers in the joined together condition.
Figure 3:
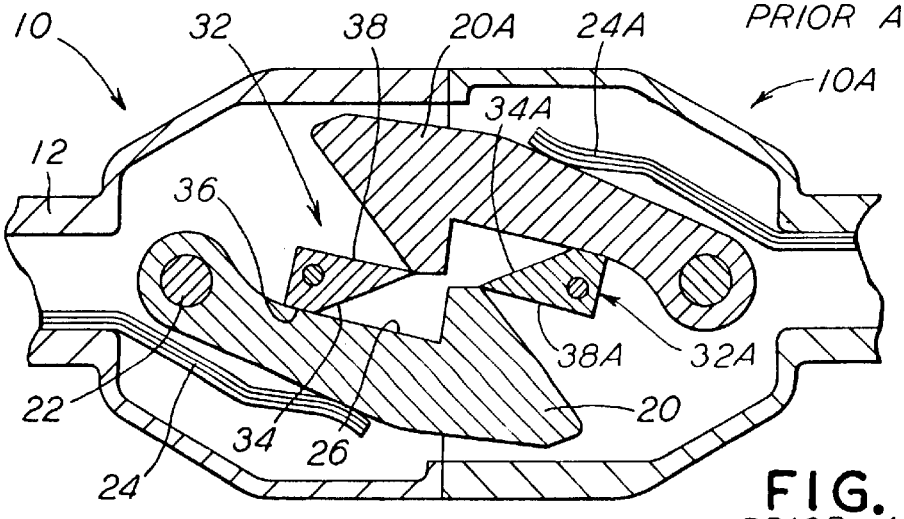
FIG. 3 PRIOR ART
FIG. 3 is again another schematic cross-sectional plan view of a pair of prior art coupler heads like FIGS. 1 and 2, but instead shows the uncoupling cam in the activated position with the hook members unjointed to permit uncoupling of the two coupler heads.

Reference to FIGS. 1–3 will illustrate in cross-section, a pair of prior art electrically operated hook-type couplers for attachment to an end of a railway transit vehicle for joining together adjacent ends of a pair of such railway transit vehicles. Such prior art couplers normally comprise a coupler head, generally designated 10, having a shank portion 12 for connecting the coupler head 10 to a frame member (not shown) of a transit vehicle (not shown). The coupler head 10 includes a gathering core 14 which in essence comprises a cavity in a flat, forward face 16 of the coupler head 10. A hook member 20 is pivotally mounted for partial rotation on pivot pin 22 within gathering core 14 and is suitably disposed to one side of gathering core 14 so that the exposed portion of a comparable hook member 20A, from another compatible coupler head 10A, can be inserted into the gathering core 14 to engage hook member 20. In a like manner and at the same time, the exposed portion of hook member 20 will be inserted within gathering core 14A so that hook members 20 and 20A engage each other to effect the desired coupling, as shown in FIG. 2. In contrast to FIGS. 1 and 2, FIG. 3 illustrates the same components wherein the uncoupling cam 32 has been activated by a partial rotation thereof to pivot hook members 20 and 20A outwardly and away from each other to the unlatch position.

As can be seen by contrasting FIGS. 1 and 2 with FIG. 3, hook member 20, as pivotally mounted on pin 22, is pivotal between a latch position as illustrated in FIGS. 1 and 2 and an unlatch position as illustrated in FIG. 3. A biasing means 24, such as a composite multiple leaf spring as shown, is also secured within gathering core 14 for purpose of biasing hook member 20 to the latch position, as illustrated in FIGS. 1 and 2, whereby flat surface 26 of hook member 20 is biased against an elongated, flat, side surface 34 on uncoupling cam 32.

As noted above, also mounted within gathering core 14 is uncoupling cam 32 which is partially rotatable for forcibly pivoting the hook member 20 to the unlatch position, as illustrated in FIG. 3, thereby overcoming the biasing action of biasing means 24 and moving hook member 20 to the unlatch position where it will not and cannot be latched to an adjacent hook member 20A. As can be seen in FIG. 3, the uncoupling cam 32 biases each of the hook members 20 and 20A away from each other to an extent that they no longer engage each other thereby permitting the transit vehicles to be separated. Also included is a pneumatically, electrically or hydraulically operated actuator (not shown) which functions to externally operate the uncoupling cam 32; i.e., partially rotating cam 32, to selectively pivot hook member 20 to the unlatch position, as shown in FIG. 3, permitting the hook members 20 and 20A to become unlatched thereby effecting an uncoupling of the joined coupler heads 10 and 10A, as well as permitting an uncoupling of the transit vehicles (not shown) to which the couplers are attached. Actuators (not shown) for partially rotating uncoupling cam 32 are well known to those familiar with the subject art and need not be described here, suffice it to note that such actuators (not shown) are not normally disposed within the gathering core 14, but are normally attached to the outer surface of the coupler head 10 and are linked to partially rotate pin 52 to which uncoupling cam 32 is rigidly attached. An example of such an actuator is disclosed and described in U.S. Pat. No. 5,499,728, assigned to the assignee of this invention, which can be either electrically or manually operated. Accordingly, U.S. Pat. No. 5,499,728 is incorporated herein by reference.

With regard to the prior art uncoupling cam 32 as illustrated, and again contrasting FIGS. 1 and 2 with FIG. 3, the action of uncoupling cam 32 can be seen. Specifically, in the latch position (FIG. 1), no rotating force is applied to uncoupling cam 32 so that flat surface 26 on hook member 20 is biased against an elongated, flat, side surface 34 on cam 32. For uncoupling, cam 32 is used to pivot hook member 20 to the unlatch position (FIG. 3). Cam 32 must be rotated counter-clockwise so that uncoupling cam 32 will force the hook member 20 outwardly, against the biasing action of spring means 24 until curved surface 36 on uncoupling cam 32 engages flat surface 26 on hook member 20. As shown in FIG. 3, when both hook members 20 and 20A are pivoted to the unlatch position, they no longer engage each other and, accordingly, the coupler heads 10 and 10A are no longer joined together, which thereby permits one transit vehicle to be driven away from the other. When the coupler heads 10 and 10A are withdrawn from each other so that the two transit vehicles (not shown) are no longer joined together, the actuator (not shown) can be deactivated, permitting biasing means 24 to pivotally bias hook member 20 back to the latch position. If for some reason cam 32 becomes stuck in the rotational position where hook member 20 is pivoted to the unlatch position, it can be seen in FIG. 3 that any effort to again join together a pair of coupler heads 10 and 10A will cause hook member 20A to contact flat surface 38 on cam 32 thereby forcing rotation of cam 32 as necessary to disengage hook member 20 from the unlatch position allowing it to return to the latch position by the force of biasing means 24. While flat surface 38 on uncoupling cam 32 does not otherwise function in the camming action of uncoupling cam 32, the flatness and angle thereof with regard to the other surfaces 34 and 36 is critical only to the extent that it must not interfere with movement of hook member 20A when the two hook members 20 and 20A are closed together as shown in FIG. 2. As should be apparent from FIG. 2, any outward extension thereof could prevent the hook member 20 or 20A from fully engaging the other hook member 20 or 20A to prevent a proper engagement of the two hook members.

Figure 4:
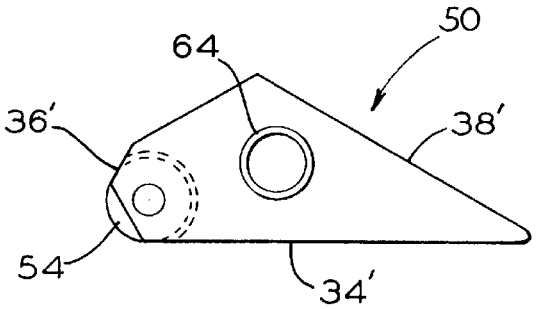
FIG. 4 is a side view of an uncoupling cam in accordance with a presently preferred embodiment of this invention.
Figure 5:
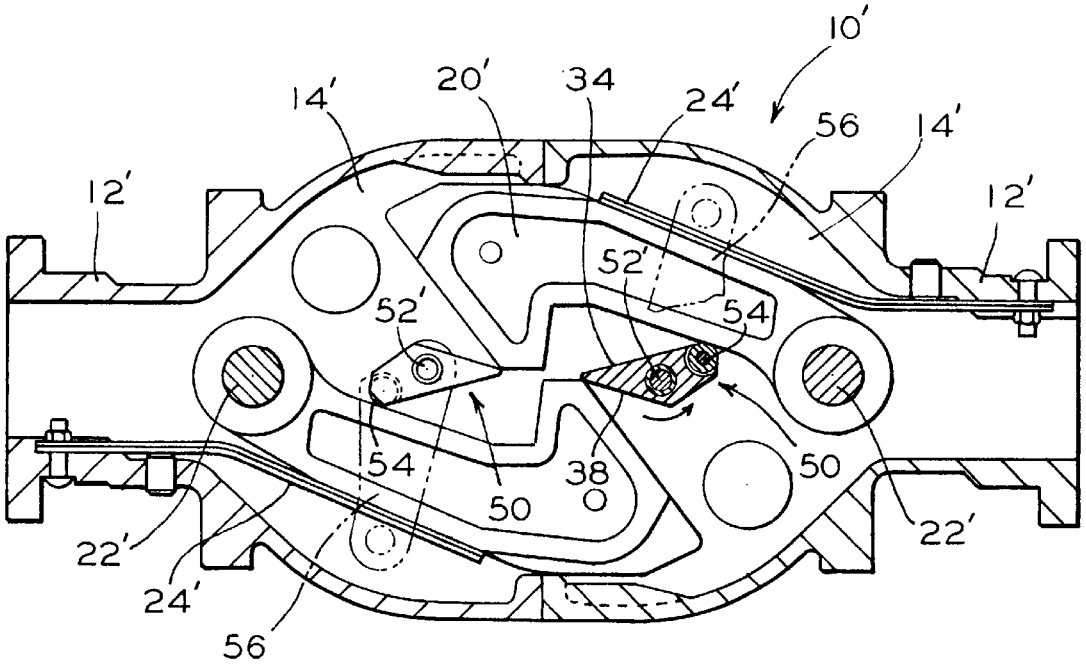
FIG. 5 is a partial cross-sectional plan view of a pair of coupler heads each including a roller equipped uncoupling cam as illustrated in FIG. 4.

The crux of this invention resides in the inventive uncoupling cam 50 as illustrated in FIGS. 4 and 5. Reference to FIG. 4 will illustrate a side view of the inventive uncoupling cam 50 in accordance with a presently preferred embodiment of this invention, while reference to FIG. 5 illustrates in partial cross-section, a pair of couplers 10', each having a shank portion 121 and a gathering core 14' with abutting forward faces. Each gathering core 14' contains a pivotal hook member 20' pivotally attached to a pin 22' with each biased toward the latch position by a biasing means such as a multiple leaf spring 24'. Each gathering core 14' includes an uncoupling cam 50 of this invention (only one of which is shown in cross-section), which is rigidly attached to pivot pin 52', and as can be seen, uncoupling cam 50 is substantially the same as prior art uncoupling cam 32 except for fact that it includes roller 54 transversely disposed at the intersection of surfaces 34' and 36', such that each of surfaces 34' and 36' is generally tangent with a cylindrical side of roller 54. Accordingly, roller 54, in essence, replaces the sharp angled intersection of surfaces 34 and 36 of the prior art uncoupling cam 32. As can be seen in FIG. 4, the inventive uncoupling cam 50 does include a pivot bushing 64 pivot pin 52' as well as surfaces 34', 36' and 38' which in essence function like pivot pin 52 and surfaces 34, 36 and 38 on prior art uncoupling cam 32. While not a part of this invention, FIG. 5 also shows a lever arm 56 within each gathering core 14' which is rigidly attached to cam 50, so that an actuator (not shown) acting through lever arm 56 will partially rotate uncoupling cam 50 to the unlatch position as illustrated in FIG. 5. As previously noted in discussing the prior art, the actuator (not shown) and the interconnecting lever arm 56 may or may not be positioned within gathering core 14 or 14', and most commonly, both are disposed on the outer surface of coupler head 10, as shown in the above-referenced patent.

Having described in detail a presently preferred embodiment of this invention, it should be apparent that other embodiments could be utilized and modifications incorporated without departing from the spirit of the invention. For example, it should be quite apparent that the uncoupling cam 50 could take different forms depending on the design and configuration of the specific coupler to which it is incorporated. An irregular, circular form typical of most cams could be developed. In addition, the coupler head and gathering core, as described in the above specification, could take any one of a number of differing designs including designs which may completely eliminate a gathering core. Clearly, therefore, other modifications could be included and other embodiments designed without departing from the spirit of the invention as defined in the appended claims.

We claim:

1. An uncoupling cam for use in a hook coupler, said hook coupler attached to an end of a railway transit vehicle for joining adjacent ends of a pair of such railway transit vehicles, said hook coupler including (i) a hook member that is capable of being pivoted between a latch position and an unlatch position, (ii) a biasing means for biasing said hook member to said latch position, and (iii) an actuator along with a pivot pin linked thereto for aiding in pivoting said hook member to said unlatch position when said actuator is activated and to said latch position when said actuator is deactivated, said uncoupling cam comprising:

(a) a solid body having a polygonal cross-section with at least two oblique side surfaces, said solid body defining an orifice into which said pivot pin fixedly attaches so that said solid body rotates with said pivot pin; and (b) a roller rotatably secured to said solid body tangent to two of said oblique side surfaces thereof, said roller adapted to rollably engage a surface of said hook member without significant friction when said solid body rotates (i) one way by activation of said actuator and thereby forces said hook member against the bias of said biasing means to pivot to said unlatch position and (ii) an opposite way by deactivation of said actuator to enable said biasing means to force said hook member to return to said latch position.

2. The uncoupling cam, according to claim 1, in which said uncoupling cam requires only partial rotation by said pivot pin to cause said hook member thereof to be forcibly pivoted to said unlatch position.

3. The uncoupling cam, according to claim 2, in which said roller is rollable on an axis of rotation parallel to an axis of rotation of said pivot pin.

4. The uncoupling cam, according to claim 1, in which said solid body has a uniform polygonal cross-section.

5. The uncoupling cam, according to claim 1, in which said solid body has a generally triangular cross-section with said roller occupying one corner thereof and said two oblique side surfaces thereof tangent to said roller.

6. The uncoupling cam, according to claim 1, in which said solid body has said two oblique side surfaces tangent to said roller such that a first of said oblique side surfaces will abut against said hook member when said hook member is in said latch position and a second of said oblique side surfaces will abut against said hook member when said hook member is in said unlatch position.

7. An uncoupling cam for use in a hook coupler at an end of a railway transit vehicle for joining adjacent ends of a pair of such railway transit vehicles, said hook coupler including (i) a hook member therein capable of being pivoted between a latch position and an unlatch position, (ii) a means for biasing said hook member to said latch position, and (iii) an actuator along with a pivot pin linked thereto for aiding said hook member in pivoting to said unlatch position when said actuator is activated and allowing said biasing means to bias said hook member to said latch position when said actuator is deactivated, said uncoupling cam comprising:

(a) a solid body having a polygonal cross-section and defining an orifice into which said pivot pin fixedly attaches so that said solid body rotates with said pivot pin; and (b) a roller rotatably secured within a corner of said solid body, said roller adapted to rollably engage a surface of said hook member when said solid body rotates (i) one way by activation of said actuator and thereby forces said hook member against the bias of said biasing means to pivot to said unlatch position and (ii) an opposite way upon deactivation of said actuator thereby enabling said biasing means to force said hook member to return to said latch position without significant sliding frictional engagement between said uncoupling cam and said hook member.

8. The uncoupling cam, according to claim 7, in which said solid body has a generally triangular cross-section with said roller occupying one corner thereof and at least two oblique side surfaces thereof tangent to said roller.

9. The uncoupling cam, according to claim 7, in which said uncoupling cam requires only partial rotation by said pivot pin to cause said hook member thereof to be forcibly pivoted to said unlatch position.

10. The uncoupling cam, according to claim 9, in which said roller is rollable on an axis of rotation parallel to an axis of rotation of said pivot pin.

* * * * *